US005441185A

United States Patent [19]

Dragos

[11] Patent Number: 5,441,185

[45] Date of Patent: Aug. 15, 1995

[54] WALLPAPER WORK BELT AND ACCESSORIES

[76] Inventor: Michael R. Dragos, 7038-H Brandemere La., Winston Salem, N.C. 27106

[21] Appl. No.: 209,300

[22] Filed: Mar. 14, 1994

[51] Int. Cl.[6] ..... A45F 5/00

[52] U.S. Cl. ..... 224/151; 224/252; 224/251; 224/268; 224/904; 15/236.01

[58] Field of Search ..... 224/252, 253, 904, 226, 224/225, 268, 151, 251; 425/458, 470; 7/105; 81/488; 15/236.01, 236.02, 245; 30/169; D3/228, 224; 24/196, 176, 177

[56] References Cited

U.S. PATENT DOCUMENTS

D. 140,745 4/1945 Fairbairn et al. ..... 224/232
4,923,105 5/1990 Snyder ..... 224/253
5,004,136 4/1991 Leath ..... 224/253
5,303,860 4/1994 Serafini, Jr. ..... 224/253

FOREIGN PATENT DOCUMENTS 75509 2/1919 Austria ..... 224/252

*Primary Examiner*—Linda J. Sholl

[57] ABSTRACT

A wallpaper work belt and accessories including an adjustable waist belt having various tool holders disposed thereon. Tool holders include a smoothing brush holder for right or left handed dispositions, a seam roller holder, a specialized edger, and a cleaning cloth holder. An angular disposition of the smoothing brush holder facilitates insertion and extraction of the smoothing brush during use. The smoothing brush holder and edger holder are detachably affixed to the waist belt and may be removed and cleaned using conventional hot water cleaning techniques.

1 Claim, 3 Drawing Sheets

WALLPAPER WORK BELT AND ACCESSORIES

BACKGROUND OF THE INVENTION

1. Field of the Invention

The present invention relates to handtools and tool holders and more particularly pertains to a wallpaper work belt and accessories which may be employed to hold specialized tools devised for use by individuals engaged in wallpaper installation or similar occupations.

2. Description of the Prior Art

The use of work belts and accessories is known in the prior art. More specifically, wallpaper work belts and accessories heretofore devised and utilized for holding tools used by wallpaper installers are known to consist basically of familiar, expected and obvious structural configurations, notwithstanding the myriad of designs encompassed by the crowded prior art which have been developed for the fulfillment of countless objectives and requirements.

The present invention is directed to improving devices for a wallpaper work belt and accessories in a manner which is safe, secure, economical and aesthetically pleasing.

For example, U.S. Pat. No. 4,828,154 to Clifton, Jr. discloses a hand tool organizer comprising a holster for a pistol grip type hand tool and accessories wherein the holster is suspended from the waist belt of the wearer and a leg encircling strap holds the holster against the leg. The Clifton, Jr. invention has no provisions for holding those tools required for installation of wallpaper such as a smoother brush, a roller, and an edger. The present invention comprises a complete equipment for holding a smoother brush, a roller, and an edger and furthermore the invention is independent of any article worn and thereby does not require use of the wearer's waist belt.

In U.S. Pat. No. 4,372,468 to Harvey a tool holder is disclosed comprising a pad support affixed to the waist belt of a user and a pivotally mounted snap lock device supporting a hammer or other tool from the user's waist belt. The Harvey invention does not have provisions for holding tools used by wallpaper installers and is generally limited to holding a single tool. And furthermore the Harvey invention requires the use of the wearer's waist belt which may not always be present, particularly when overalls are worn. The present invention is specifically designed for holding the tools required by wallpaper installers and does not require the presence of an existing waist belt.

In U.S. Pat. No. 4,645,104 to Vokaty a tool holder is described. The Vokaty invention holds T-shaped tools by having a head engaging portion and a tail engaging portion. The Vokaty invention is affixed to the user's waist belt and has no provision for holding more than one tool. The present invention does not attach to the user's waist belt and holds more than one tool of use to wallpaper installers, and furthermore is not designed to hold only T-shaped tools.

In U.S. Pat. No. 4,496,088 to Tuthill a tool holder is disclosed for supporting pliers upon a user's waist belt or knife sheath. A disadvantage in this prior art lies in a lack of a provision for holding tools commonly employed in wallpaper installation. And furthermore the Tuthill invention attaches to the user's waist belt. The present invention does not require use of the user's waist belt and holds those tools essential to the successful installation of wallpaper. There is no provision or need in the present invention to hold pliers.

In this respect, the wallpaper work belt and accessories according to the present invention substantially departs from the conventional concepts and designs of the prior art, and in so doing provides an apparatus primarily developed for the purpose of holding and providing the specialized tools required to successfully install wallpaper or similar materials.

Therefore, it can be appreciated that there exists a continuing need for a new and improved wallpaper work belt and accessories which can be worn and used by wallpaper installers to facilitate the installation of wallpaper and related materials. In this regard, the present invention substantially fulfills this need.

As illustrated by the background art, efforts are continuously being made in an attempt to improve tool holders and wallpaper installation tools. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of tool holders and wallpaper installation tools now present in the prior art, the present invention provides an improved wallpaper work belt and accessories construction wherein the same can be utilized for holding the specialized tools required for the installation of wallpaper and related materials. As such, the general purpose of the present invention, which will be described subsequently in greater detail, is to provide a new and improved wallpaper work belt and accessories apparatus and method which has all the advantages of the prior art wallpaper work belt and accessories and none of the disadvantages.

The invention is defined by the appended claims with the specific embodiment shown in the attached drawings. For the purpose of summarizing the invention, the invention may be incorporated into a waist belt member holding a series of tool holders with respective tools including a smoothing brush, a seam roller, an edger, and a cleaning cloth. The waist belt member is generally of fabric construction and the tool holders are of plastic composition capable of undergoing manual, dishwasher, or other forms of cleaning.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved wallpaper work belt and accessories having an integral waist belt and a series of tool holders disposed thereon.

It is therefore an additional object of the present invention to provide a new and improved wallpaper work belt and accessories which has all the advantages of the prior art wallpaper work belt and accessories and none of the disadvantages.

It is another object of the present invention to provide a new and improved wallpaper work belt and accessories which may be easily and efficiently manufactured and marketed.

It is a further object of the present invention to provide a new and improved wallpaper work belt and accessories which is of a durable and reliable construction.

An even further object of the present invention is to provide a new and improved wallpaper work belt and accessories which is susceptible of a low cost of manufacture with regard to both materials and labor, and which accordingly is then susceptible of low prices of sale to the consuming public, thereby making such wallpaper work belt and accessories economically available to the buying public.

Still yet another object of the present invention is to provide a new and improved wallpaper work belt and accessories which provides in the apparatuses and methods of the prior art some of the advantages thereof, while simultaneously overcoming some of the disadvantages normally associated therewith.

Still another object of the present invention is to provide a new and improved wallpaper work belt and accessories which includes a series of specially designed wallpaper installation tools.

Yet another object of the present invention is to provide a new and improved wallpaper work belt and accessories which is capable of being usefully employed by either right or left handed persons.

Even still another object of the present invention is to provide a new and improved wallpaper work belt and accessories which is adjustable and can comfortably fit a wide range of human body waist forms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
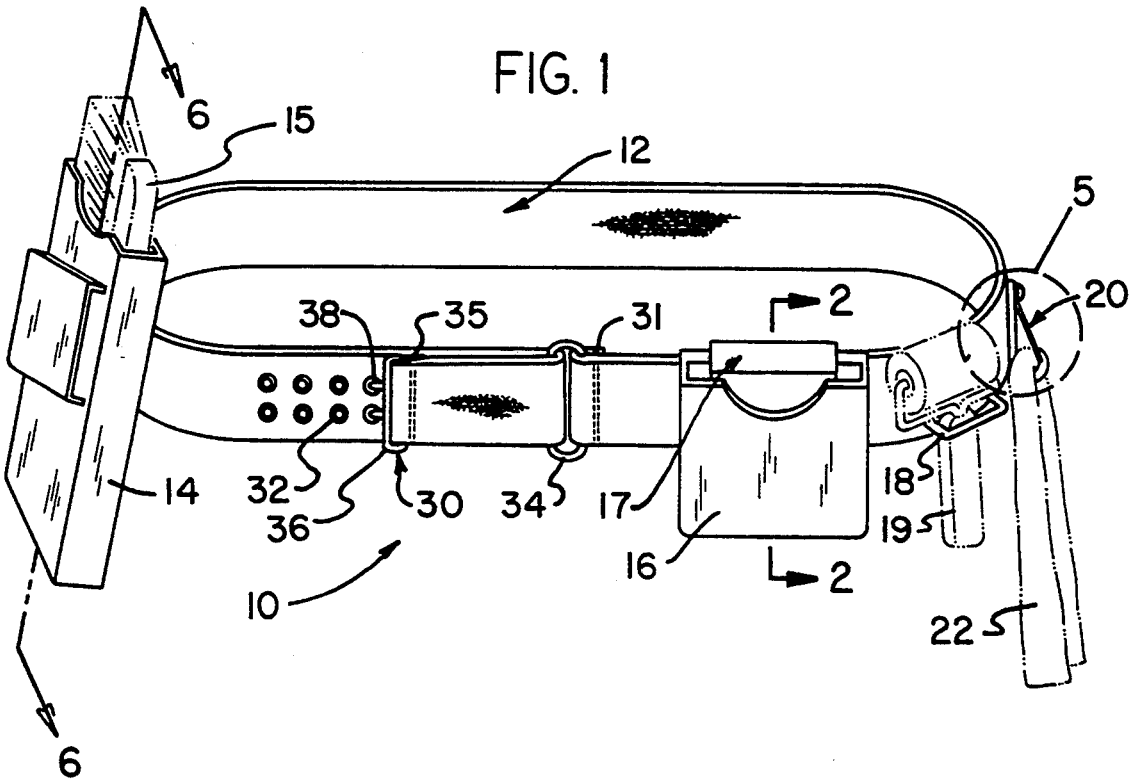
FIG. 1 is a perspective view of the wallpaper work belt and accessories showing the adjustable waist belt and four tools mounted thereon.

With reference now to the drawings, and in particular to FIG. 1 thereof, a new and improved wallpaper work belt and accessories embodying the principles and concepts of the present invention and generally designated by the reference numeral 10 will be described.

From an overview standpoint, the wallpaper work belt and accessories 10 is adapted for use by an individual installing wallpaper to hold specialized tools and accessories thereon. See FIG. 1. The wallpaper work belt and accessories 10 comprises an adjustable waist belt 12 to which a smoothing brush holder 14 and smoothing brush 15, an edger holder 16 and quick edger 17, a seam roller ring holder 18 and seam roller 19, and a cleaning cloth clip 20 and cleaning cloth 22 are attached and positioned thereon for quick access and replacement.

More specifically, it will be noted that the wallpaper work belt and accessories 10 comprises a waist belt member 12 having an adjustment device 30. Waist belt member 12 is constructed from a fabric such as canvas and may be formed in multiple layers using stitched seams. Alternate waist belt 12 materials include leather, plastic, or other compositions providing a durable, flexible, and washable belt form. Adjustment device 30 comprises a plurality of grommetted holes 32, a first metal or plastic ring 34, and a second metal or plastic ring 36 having two hole engagement hooks 38 affixed thereon.

A first free end 31 of waist belt member 12 is threaded through first metal or plastic ring 34 and adhesively or stitchedly affixed upon itself thereby forming a closed loop securing said first metal or plastic ring 34 to said first free end. A second free end 35 of waist belt member 12 having grommetted holes 32 disposed thereon is threaded through the second metal or plastic ring 36 and adhesively or stitchedly affixed upon itself thereby forming a closed loop securing said second metal or plastic ring 36 to said second free end. In use, the second free end 35 of waist belt member 12 is threaded through the first metal or plastic ring 34 and folded back upon itself to a comfortable site whereupon hooks 38 are caused to engage an appropriately disposed pair of grommetted holes 32 thereby securing the wallpaper work belt and accessories 10 to the user.

Figure 2:
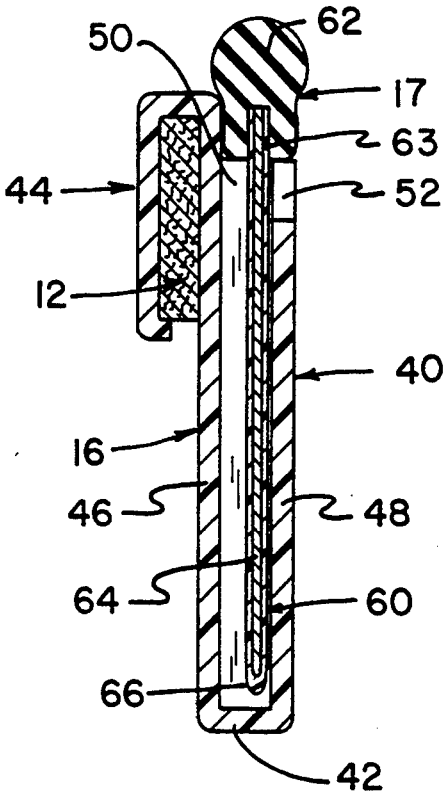
FIG. 2 is a sectional view of the wallpaper work belt taken substantially upon the plane shown by section lines 2—2 of FIG. 1.
Figure 3:
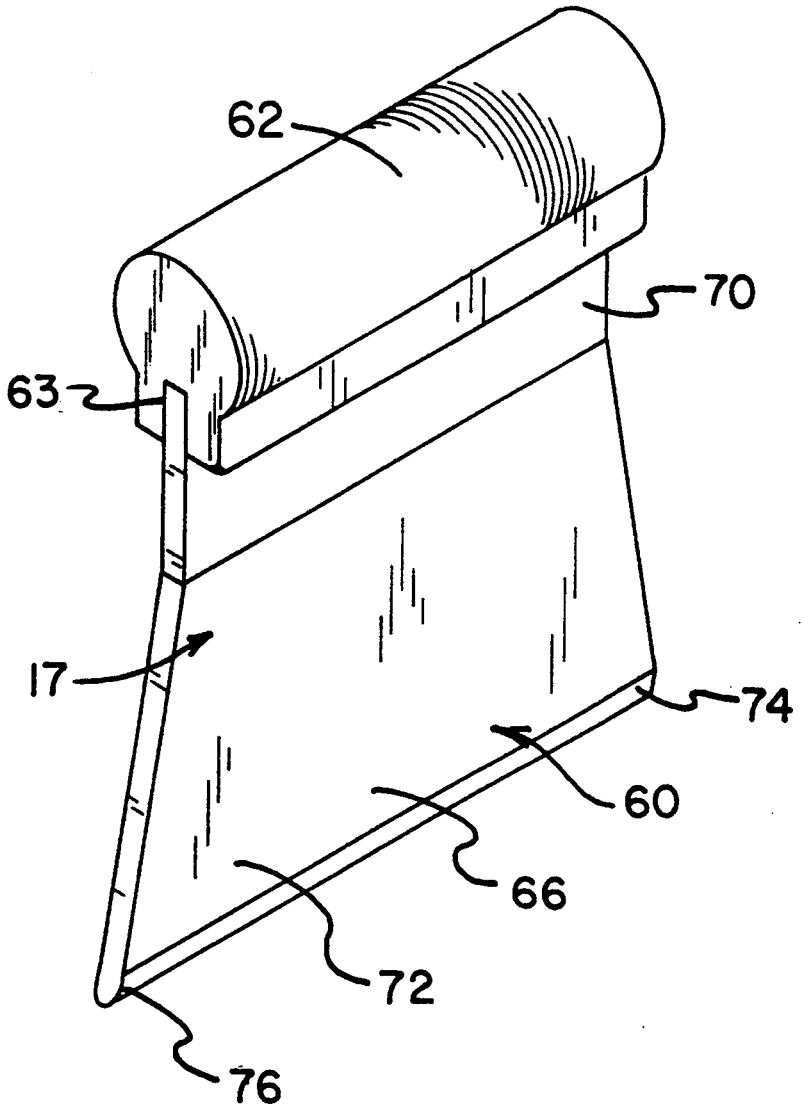
FIG. 3 is perspective view of the wallpaper work belt and accessories showing the edger accessory.
Figure 4:
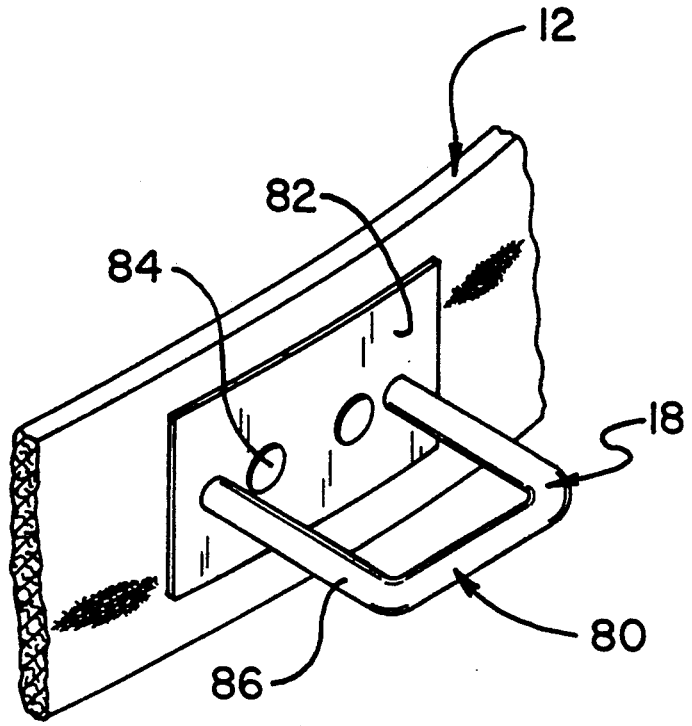
FIG. 4 is a fragmentary perspective view of the wallpaper work belt and accessories showing a holding ring for a seam roller.
Figure 5:
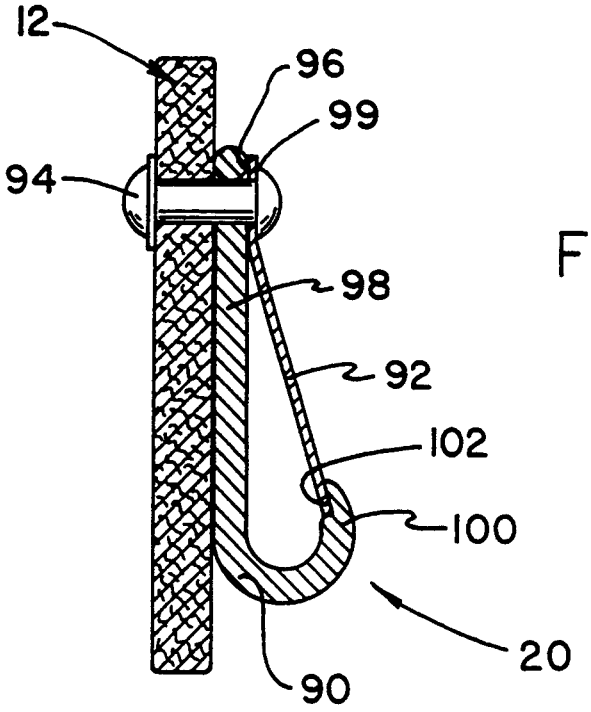
FIG. 5 is a sectional view of the wallpaper work belt and accessories showing a cleaning cloth clip and taken substantially upon the plane indicated by the section line 5—5 of FIG. 1.
Figure 6:
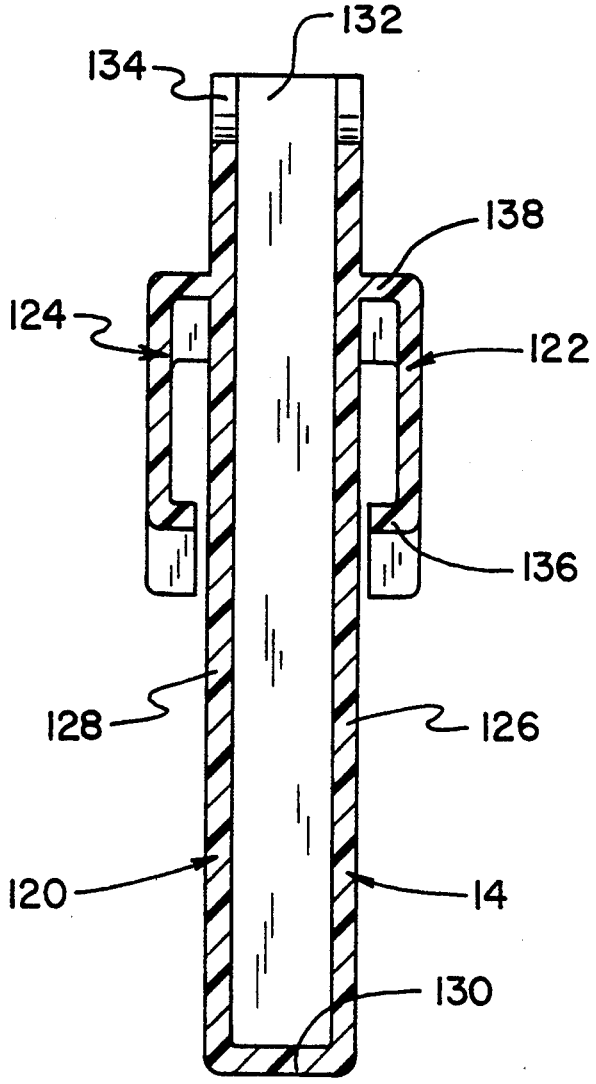
FIG. 6 is a side sectional view of the wallpaper work belt and accessories taken substantially upon the plane indicated by the section line 6—6 of FIG. 1 and showing the smoothing brush holder detached from the waist belt.

Edger holder 16 comprises a substantially rigid pocket member having four sides 40, a bottom 42, and an extended hooklike waist belt engaging member 44. See FIG. 2. Sides 40 comprise a back 46 comprising a portion in continuity with the waist belt engaging member 44, a front portion 48, and two narrow elongated side portions 50 formed in continuity with the back 46 and front portion 48 and thereby generating a resultant pocket. Front portion 48 has a singular tool access portion 52 removed thereby providing finger access to the quick edger tool 17 held therein. Quick edger 17 comprises a blade member 60 and handle member 62 wherein the blade member 60 is firmly affixed to the handle member 62 by adhesive, threaded fastener, frictional engagement, or other means. See FIG. 3.

Handle member 62 comprises an elongated substantially rectangular semisolid having a slot 63 disposed along the entire length of a side therein and penetrating a substantial distance therein in order to provide an adequate system of mating surfaces to provide a substantially rigid attachment of handle member 62 to blade member 60. Handle member 62 is approximately three inches long and is a three quarter inch square in cross section. Blade member 60 comprises a centrally disposed metal portion 64 coated by a polymeric layer 66, or equivalently the entire blade member 60 may comprise either a metal, wood, polymeric, or composite material. Blade member 60 additionally comprises a first portion 70 engaging slot 63 a second portion 72 which widens to a width substantially greater than the length of handle member 62, and a triangular edge portion 74 which produces a sloping surface on one side and a sharp edge on a side opposite thereby providing a substantially sharp edge 76 useful for performing edging operations.

Edge portion 74 is approximately five inches long. The overall height of the quick edger is approximately seven inches and is measured from a point near the center of the edge portion 74 to a closest point of the furthermost surface of the handle member 62. Seam roller ring holder 18 comprises a ring member 80, a backing plate 82, and fastening rivets 84. Ring member 80 comprises a rodlike member formed into a U shape having equal length legs 86 wherein the legs 86 are affixed to the backing plate 82 by staking or welding thereby completing a continuous ring form. Backing plate 82 comprises a substantially flattened or slightly curved plate having two or more through holes disposed thereon which are aligned with complementary through holes in waist belt member 12. Rivets 84 secure the backing plate 822 to the waist belt member 12.

Any of a variety of seam rollers 19 may insertedly engage the seam roller ring holder 18 being held by engagement of the ring member 80 and the enlarged roller member of the seam roller 19. The seam roller ring holder 18 is generally of metal composition, however composites and some plastics may be employed in the seam roller ring holder construction. And ring member 80 may alternately comprise a non-rodlike form wherein any of a number of shapes may be employed to form an encircling structure for the purpose of holding a seam roller. Cleaning cloth clip 20 comprises a J-shaped hooklike member 90, a springlike retainer 92, and a fastener 94. J-shaped hooklike member 90 comprises a substantially flattened hook having a through hole 96 disposed at a free end of an elongated portion 98 thereof. Springlike retainer 92 engages fastener 94 at one free end 99 thereof and at free end 100 of the J-shaped hooklike member 90 at an opposite free end 102. Fastener 94 comprises a rivet which engages holes penetrating waist belt 12 thereby affixing the cleaning cloth clip 20 to waist belt 12. Smoothing brush holder 14 comprises a pocket 120 having a right side clip 122 and a left side clip 124 wherein said pocket 120 holds smoothing brush 15 and clips 122 and 124 are employed to affix the smoothing brush holder 14 to the waist belt 12.

Pocket 120 comprises a first sidewall portion 126 having right side clip 122 disposed thereon, a second sidewall portion 128 having left side clip disposed thereon, a bottom portion 130 and two opposing narrow sidewall portions 132 providing continuity therewith and maintaining spacing thereof first and second sidewall portions 126 and 128. First and second sidewall portions 126 and 128 have substantially identical smoothing brush access portions 134 disposed at the free ends thereof. The smoothing brush access portions 134 comprise cutouts having the purpose of permitting free hand access to the smoothing brush 15 for removal.

Right side clip 122 comprises a wide flattened member formed into a U shape wherein a leg 136 of the U is shortened and a second leg 138 of the U is somewhat longer than leg 136 and furthermore leg 138 is affixed to or continuous with first sidewall portion 126. Right side clip 122 engages waist belt 12 on the right side of a right handed user thereby affixing the smoothing brush holder 14 to waist belt 12 for use.

Right side clip 122 is angularly disposed upon sidewall portion 126 in a manner which slants the smoothing brush holder 14 so that a plane containing a narrow sidewall portion 132 forms an acute angle with a half plane containing the waist belt 12 portion encircling the front half of the user's waist. The slant of the smoothing brush holder facilitates extraction and insertion of the smoothing brush 15 which, being a relatively long brush, would be difficult to insert if such a forward slanting holder 14 were otherwise disposed. Likewise, left side clip 124 is angularly disposed upon sidewall portion 128 in a manner which slants the smoothing brush holder 14 so that a plane containing a narrow sidewall portion 132 forms an acute angle with a half plane containing the waist belt 12 portion encircling the front half of the user's waist thereby facilitating insertion and extraction of smoothing brush 15 for left handed users.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A wallpaper work belt and accessories for holding tools used by humans in the installation of wallpaper and similar materials comprising:

a waist belt comprising a flexible substantially flattened member having a length adjustment means, said waist belt comprising a woven fabric composition comprising a polymer based woven fabric composition, said waist belt adjustment means comprising a first ring member affixed to a free end of the waist belt and a second ring member affixed to a second free end of the waist belt wherein said second ring member has two hooks affixed thereon and is furthermore threaded through said first ring member when encircling a user and said waist belt has a series of through hole pairs disposed thereon wherein said hooks engage a through hole pair corresponding to a desirable waist belt length thereby securing said waist belt to the user;

a smoothing brush holder detachably affixed to said waist belt, said smoothing brush holder comprising an elongated pocket member having a first waist belt attachment means operationally disposed when affixing the smoothing brush holder to the right side of the user and a second waist belt attachment means operationally disposed when affixing the smoothing brush holder to the left side of the user and said first and second waist belt attachment means provide an angular disposition rendering an uppermost portion of the elongated pocket member in a position more forward than a bottommost portion of said elongated pocket member irregardless of the side of attachment of the smoothing brush holder upon the user;

a seam roller holder affixed to said waist belt, said seam roller holder comprising a continuous ring affixed to said waist belt and engaging a portion of an existing seam roller thereby maintaining said seam roller at the waist belt for use;

an edging tool and edging tool holder affixed to said waist belt, said edging tool comprising a handle member affixed to a blade member wherein said handle member is an elongated rectangular semi-solid having a blade engagement slot formed therein, said blade member comprising a metal blade having a polymeric coating applied thereon and furthermore said blade member is substantially wider at a free end than at an opposing end wherein said opposing end forms a portion engaging said handle member and said wider free end terminates in a triangular cross section; and a cleaning cloth holder affixed to said waist belt, said cleaning cloth holder comprising a J-shaped hook member having a spring closing member affixed to the waist belt by a fastening means.

* * * * *